United States Patent [19]

Lenkey

[11] Patent Number: 4,848,373

[45] Date of Patent: Jul. 18, 1989

[54] NICOTINE REMOVAL PROCESS AND PRODUCT PRODUCED THEREBY

[75] Inventor: Attila A. Lenkey, Short Hills, N.Y.

[73] Assignee: Helme Tobacco Company, Stamford, Conn.

[21] Appl. No.: 37,605

[22] Filed: Apr. 13, 1987

[51] Int. Cl.[4] ..... A24B 15/24

[52] U.S. Cl. ..... 131/297; 131/309; 131/352

[58] Field of Search ..... 131/297, 248, 352, 309, 131/310, 298

[56] References Cited

U.S. PATENT DOCUMENTS

| | | | |
|---|---|---|---|
| 1,551,676 | 9/1925 | McConnell . | |
| 1,823,554 | 9/1931 | Mewborne . | |
| 2,117,558 | 5/1938 | Hyatt . | |
| 2,822,306 | 2/1958 | Thienemann et al. . | |
| 3,338,248 | 8/1967 | Pauia | 131/297 |
| 3,366,126 | 1/1968 | Velez, Sr. . | |
| 3,398,754 | 8/1968 | Tughan . | |
| 3,467,109 | 9/1969 | Block et al. . | |
| 3,511,843 | 5/1970 | Lewis . | |
| 3,593,721 | 7/1971 | Knop et al. . | |
| 3,628,541 | 12/1971 | Buchmann et al. . | |
| 3,860,012 | 1/1974 | Selke . | |
| 4,011,141 | 3/1977 | Gravely et al. . | |
| 4,038,993 | 8/1977 | Geiss et al. . | |
| 4,068,671 | 1/1978 | Casey . | |
| 4,153,063 | 5/1979 | Roselius et al. . | |
| 4,215,706 | 8/1980 | Larson et al. . | |
| 4,289,147 | 9/1981 | Wildman et al. . | |
| 4,528,993 | 7/1985 | Sensabaugh, Jr. et al. . | |

*Primary Examiner*—Vincent Millin

*Attorney, Agent, or Firm*—Lucas & Just

[57] ABSTRACT

A process for removing nicotine from tobacco which does not adversely affect the flavor and aroma of the product tobacco is disclosed. The process entails mixing a tobacco having a moisture content of 25% to 53% with an alkalinizing agent to obtain a pH of 8 to 11 and maintaining the tobacco in an aerobic environment at a temperature of 40° F. to 120° F. at a pressure of 1 atmosphere for a period of 4 to 14 weeks. The product so produced is also disclosed.

14 Claims, 3 Drawing Sheets

TYPICAL TOBACCO PROCESSING

A PREFERRED EMBODIMENT

NICOTINE REMOVAL PROCESS AND PRODUCT PRODUCED THEREBY

The present invention relates to tobacco and more particularly to a process for preparing a low nicotine, smokeless tobacco product having good flavor and aroma. This process is especially suited for moist snuff.

Smokeless tobacco products, such as moist snuff and chewing tobacco, are enjoyed by inserting the smokeless tobacco product between the gum and the lip or cheek and extracting the solubles from the product with saliva. Flavor and aroma are especially important in smokeless tobacco products because of the direct contact between the product and the user's taste buds.

Known methods for reducing the nicotine content of tobacco involve the removal of the nicotine from tobacco by subjecting the tobacco to extreme conditions which remove other solubles along with nicotine and adversely effect the flavor and aroma properties of the smokeless tobacco product. For example, it has been suggested that nicotine be removed from tobacco by: spray drying tobacco in an alkaline environment, see U.S. Pat. No. 4,068,671; microbial treatment of tobacco, see U.S. Pat. Nos. 4,011,141 and 4,038,993; using a donor tobacco at 140° F. to receive the nicotine from the tobacco, see U.S. Pat. No. 4,215,706; using a gas or liquid at high pressure or temperature, see U.S. Pat. Nos. 4,289,147 and 2,822,306. These methods are drastic and call for extreme conditions which have a deleterious effect on the flavor and aroma of smokeless tobacco product made from tobacco product of these processes.

A process has now been discovered that reduces the nicotine content of tobacco without having a deleterious effect on the flavor and aroma of the tobacco product. The process of the present invention comprises mixing tobacco having a moisture content in the range of about 25% to about 53% by weight of dry solids with an alkalinizing agent to obtain a mixture having a pH in the range of about 8 to about 11 and maintaining the mixture in an aerobic environment at a pressure of about 1 atmosphere and a temperature in the range of about 40° F. to about 120° F. for a period of about 4 to about 14 weeks.

The smokeless tobacco product made from the tobacco product of the present invention is characterized by having a lower nicotine content than smokeless tobacco product made from non-treated tobacco, a pH in the range of about 8 to 10 and an aroma and flavor comparable to and even superior to smokeless tobacco product made from non-treated tobacco. In fact, moist snuff made with the tobacco product of the present invention has a mellowness not found in conventional moist snuff. It is thought that the lower nicotine content reduces the bite of conventional moist snuff thereby allowing the gentler flavors of the tobacco to come through to the user and affording the moist snuff made from the tobacco product of the present invention a mellowness not heretofore known to moist snuff.

The percent by weight figures as used in the specification and claims herein are based on the weight of dry solids including tobacco, unless otherwise specified.

Figure 1:
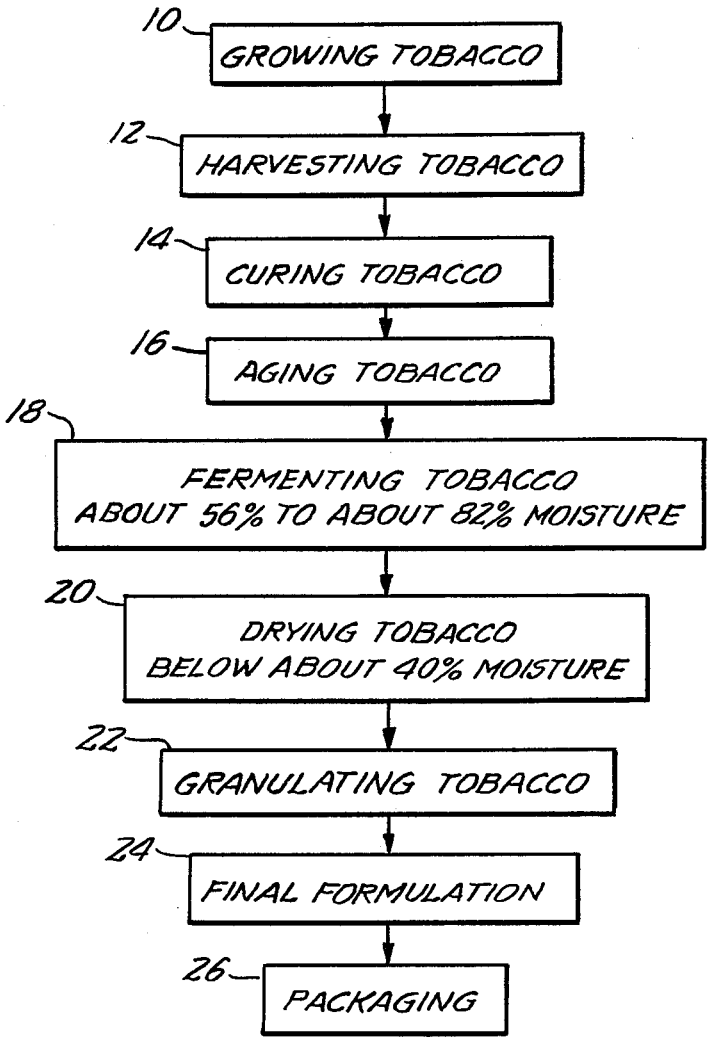
FIG. 1 illustrates a typical process for preparing a moist snuff.

Tobacco is a field crop which, after harvesting, is typically subjected to a curing step. Generally, tobacco used in moist snuff is fire cured. Fire curing entails hanging the tobacco in barns provided with ventilation louvers and subjecting the hung tobacco curing the latter stages of the curing to heat and smoke from hard wood fires on the floor of the barn.

Once the tobacco is cured, it is packed into wooden drums called hogsheads or cardboard cartons and aged for a period of about two years. During aging the tobacco is periodically inspected.

After the tobacco has been aged, it is subjected to a fermenting process wherein the moisture level of the tobacco is increased to between about 56% to 82% by weight of dry solids and microorganisms, naturally present on the tobacco, are allowed to act upon the tobacco. Generally, salts, glycerin, and licorice are mixed with the fermenting tobacco. The bulk fermentation process takes place in open warehouses, generally in bins that hold from 7,500 to 40,000 pounds. Every seven to ten days the fermenting tobacco is turned and rotated to allow for even fermentation. The contents of each bin are subject to about 4 turns and the total fermentation process entails a period of about four to seven weeks. During this period the tobacco is periodically inspected and tested to determine the extent of the fermentation. The pH of the tobacco during this process is usually acidic, about 7 and below. Bulk fermentation is generally accompanied by the generation of heat, absorption of oxygen and the evolution of carbon dioxide, ammonia and other gases.

The amount of heat generated by the bulk fermentation process is typically high. There is a rise of about 30° to about 40° F. in the tobacco measured over a seven to ten day period between rotations. Typically, the bulk fermenting tobacco starts at about 60° F. in the summer months and can climb to a temperature as high as about 130° F. during the seven to ten day rotation period. During a seven to ten day rotation period, in the summer months, the temperature of the tobacco at the exterior of the bin has a value greater than the atmospheric temperature, and the temperature of the tobacco at the interior of the bin can climb to about 130° F. Due to the rotation process, the tobacco at the exterior of the bin is rotated to the interior of the bin and the tobacco on the interior of the bin is rotated to the exterior. Once the rotation is complete, the tobacco in the interior of the bin starts to experience an increase in temperature and eventually arrives at about 130° F. while the 130° F. tobacco on the exterior of the bin eventually cools. Such temperature changes accompany each rotation period.

During bulk fermentation, the moisture level is maintained between about 56% to about 82% by weight. To terminate bulk fermentation, the moisture content of the tobacco is decreased to about 40% and below by weight.

After dropping the moisture level, the tobacco is granulated if such has not already been done and further additives are mixed with the tobacco product to produce a smokeless tobacco product. Finally, the smokeless tobacco product is packaged for sale.

Referring to FIG. 1, tobacco is grown, 10, in a field, harvested, 12, and then subjected to a curing step 14. After curing 14, the tobacco is packaged in hogsheads and subjected to aging, 16, for about two years. After aging, 16, the tobacco is subject to a fermentation step, 18, for about four to seven weeks where the moisture content is raised to about 56% to about 82% by weight dry solids and the tobacco is rotated every seven to ten days. Such fermentation is generally conducted in bulk. Bulk fermentation is terminated by drying the tobacco, 20, to a moisture content of about 40% by weight dry solids and granulating the tobacco, 22 if granulation has not already been performed. Next, additives such as flavorings, salts and water are mixed, 24, with the tobacco product and finally the moist snuff is packaged for sale, 26.

After the final formulation step, 24, some manufacturers allow the snuff to marry or age. This marrying step may occur over a period of time and some additional fermentation may occur. This marrying step is referred to as post fermentation aging. The moisture content of the snuff as it leaves the final formulation is generally about 122% by weight.

Figure 2:
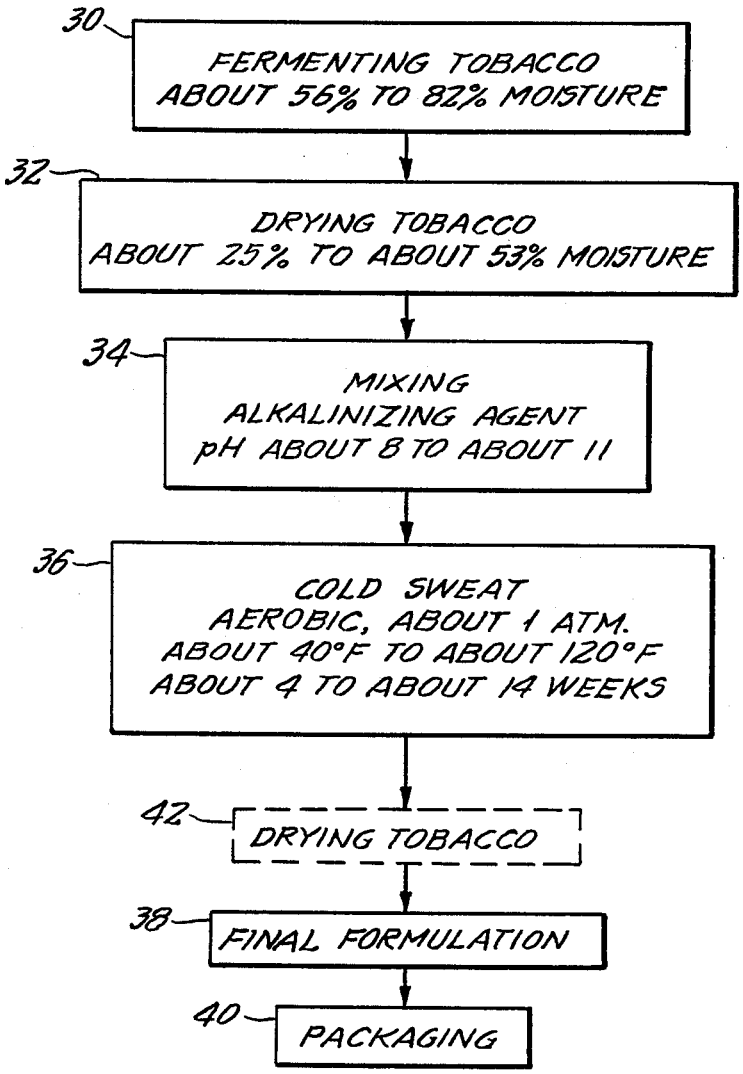
FIG. 2 illustrates a preferred embodiment of the present invention.

Turning to FIG. 2, a preferred embodiment of the present invention, fermenting tobacco 30 at a moisture level of about 56% to about 82% by weight is subjected to a drying step 32 to drop the moisture level down in the range of about 25% to about 53% by weight. More preferred the moisture is dropped to a level of about 30% to about 45% by weight and most preferred is moisture levels of about 36% to about 42% by weight. The drying step is conducted in a conventional manner.

Next, the dried tobacco from step 32 is mixed with an alkalinizing agent 34. The mixing can be accomplished with conventional equipment or by hand. The amount of alkalinizing agent added to the tobacco is determined by the resulting pH of the mixture of tobacco and alkalinizing agent. The pH of the tobacco after the addition of the alkalinizing agent should be in the range of about 8 to about 11, more preferred about 8 to about 9 and best results at about 8.5 because that is the pH at which the smokeless tobacco product is preferred. Larger additions of alkalinizing agent which result in a pH above about 11 can be used to remove nicotine from the tobacco, however, such a higher pH has a deleterious effect on the flavor and aroma of tobacco. Lower amounts of alkalinizing agent do not accomplish the denicotining process of the present invention within acceptable time limits.

After mixing the alkalinizing agent with the tobacco, the resulting mixture is subject to a cold sweat step 36. The term cold sweat as used in the specification and claims means an accelerated aging process wherein constituent changes occur in the tobacco without a significant temperature increase in the tobacco. During this cold sweating step the tobacco mix is kept in an aerobic environment whereby fresh air can reach the tobacco mix. The cold sweating step 36 includes packaging the tobacco mix into cardboard cartons which are lightly sealed with tape to prevent dust and dirt from getting into the carton but allowing air to circulate to and from the tobacco mix. The tobacco mix should be maintained at a pressure of about 1 atmosphere. A vacuum can be used to increase the rate at which nicotine is removed from the tobacco mix but such adds an unneeded expense. During the cold sweating step the temperature of the tobacco mix should be in the range of about 40° F. to about 120° F. A more preferred range is between about 60° F. and about 100° F. Even more preferred is a temperature range of about 75° to about 90° F. Most preferred is a temperature of about 85° F. Temperatures below about 40° F. substantially retards the denicotining process. Adding heat to obtain a temperature above 120° F. starts to have a deleterious effect on flavor and aroma. The tobacco mix during the cold sweat step experiences only a slight rise in temperature, typically about 3° F. during the cold sweat period.

The cold sweating process takes about 4 to about 14 weeks. More preferred is to allow the sweating process to take about 4 to about 12 weeks and good results have been obtained when the cold sweat process runs for a period of about 5 to about 8 weeks.

It has been found that the cold sweating process takes less time at higher temperature. Good results have been obtained at a temperature of about 85° F. in a period of about 4 to about 6 weeks. Care must be taken, however, because the higher temperature, about 120° F., has a deleterious effect on the flavor and aroma of the tobacco product. Time and temperature must be balanced to produce a good flavor and aroma while still dropping the nicotine content to the desired level. It will also be understood by those of skill in the art that tobacco varies greatly, depending on the type of growing conditions it was subjected to and that the growing conditions will affect the rate at which the tobacco releases its nicotine during the cold sweat process of the present invention.

After the cold sweat step, 36, has been completed, the tobacco product is subjected to a final formulation step 38 in which additives such as flavorings, salts and water are mixed with the tobacco product to produce a smokeless tobacco product. Finally, the smokeless tobacco product is packaged, 40.

The tobacco can be granulated prior to bulk fermentation 30, after bulk fermentation 30, prior to the cold sweat 36 or after the cold sweat 36. Good results have been achieved by granulating the tobacco during the step of mixing an alkalinizing agent with the tobacco, step 34. Granulating at this point helps to mix the alkalinizing agent in with the tobacco.

The steps of granulating, final formulation and packaging are carried out in a conventional manner.

After the cold sweat step 36, the tobacco product is preferably dried, 42, prior to the final formulation step 38. Such a drying step terminates further reduction of nicotine and fixes the flavor and aroma of the tobacco product.

Suitable alkalinizing agents for the present invention increase the pH of the tobacco into the desired ranges of about 8 to about 11; more preferred about 8 to about 9 and most preferred about 8.5 because that is the pH at which the smokeless tobacco product is preferred. The alkalinizing agent should not have adverse effects on the tobacco and tobacco product; especially on the aroma and flavor of the tobacco product and smokeless tobacco product made therefrom. Suitable alkalinizing agents include sodium carbonate, potassium carbonate, calcium oxide, magnesium oxide, sodium phosphate, sodium hydroxide and sodium bicarbonate. Most preferred is sodium carbonate. Sodium carbonate is readily available as soda ash and sodium carbonate monohydrate.

The amount of sodium carbonate needed to produce a pH of between about 8 to about 11 is between about 1% to 6% by weight dry solids. More preferred is to use about 2% to about 5% by weight, and best results have been obtained with about 4% by weight dry solids.

The alkalinizing agent can be added as a dry component to the tobacco in step 34 or can be added as an aqueous solution. If the alkalinizing agent is added as an aqueous solution, care should be taken not to increase the moisture level above about 53% by weight. Increasing the moisture above 53% will start the fermentation process again. If fermentation process is started again, it can have adverse effects on the flavor and aroma of the tobacco product and smokeless tobacco product produced therefrom.

The tobacco product so produced has a pH between about to about 11, more preferred between about 8 to about 9 and good taste and aroma have been obtained at a pH of about 8.5. The nicotine content of the smokeless tobacco product of the present invention has a reduction of about 50% from a smokeless tobacco product made from a tobacco not subject to the denicotizing process of the present invention with a minimum loss of other key components from the tobacco. The moist snuff made from the tobacco product of the present invention is also characterized as having mellowness not heretofore exhibited by moist snuff.

The process of the present invention is preferably used on tobacco after it has been taken from the bulk fermentation process and before the step of final formulation. The process of the present invention can also be used with tobacco during the aging step 16, FIG. 1, prior to the bulk fermentation step. If the moisture level of the tobacco is below about 25%, then water can be added.

The disclosure has been directed to moist snuff, however, it is equally applicable to chewing tobacco and can be employed for smoking tobacco. Both chewing tobacco and smoking tobacco are generally subjected to a bulk fermentation step.

These and other aspects of the present invention may be more fully understood with respect to the following examples.

EXAMPLE 1

Figure 3:
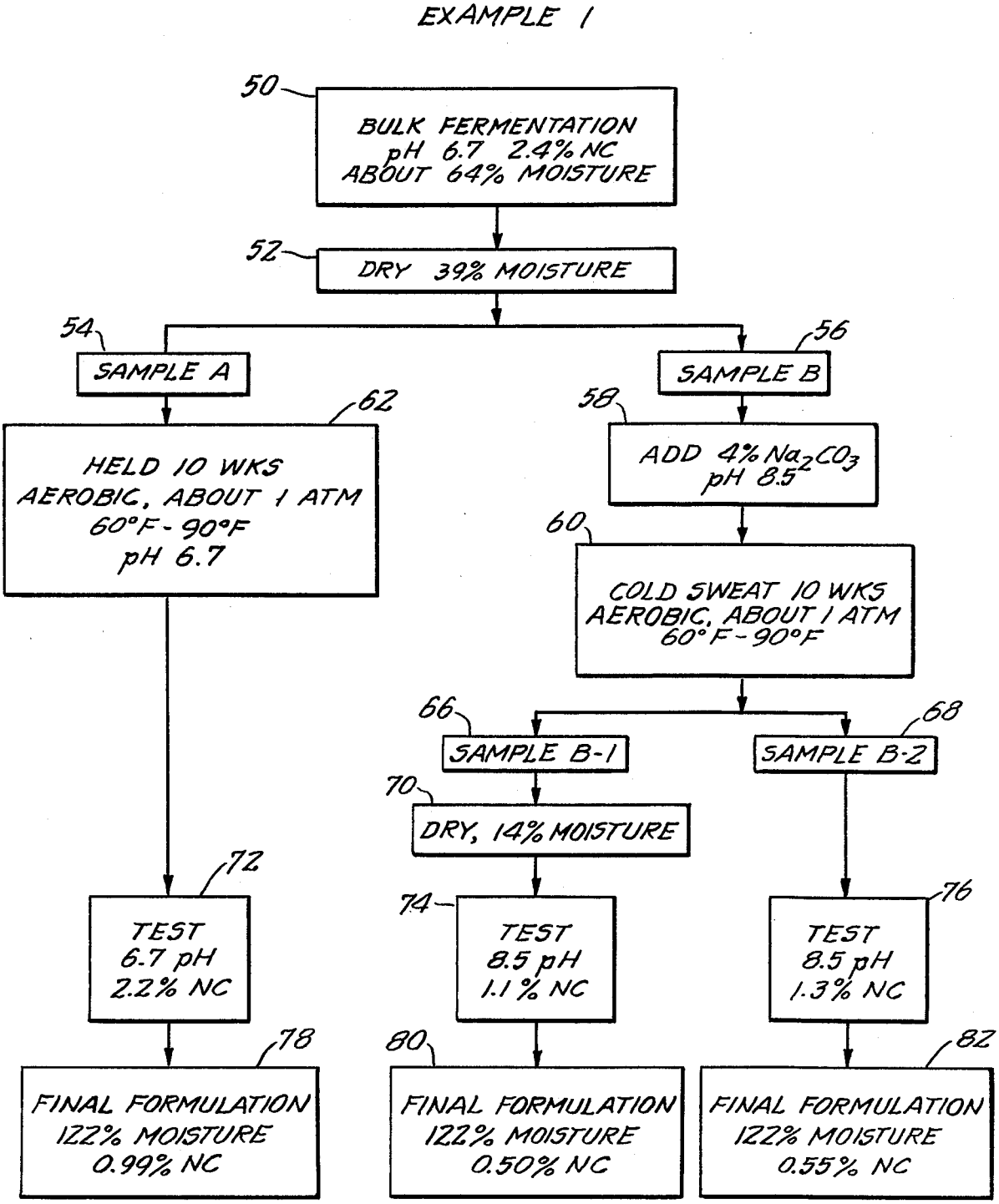
FIG. 3 illustrates Example 1 herein.

This example illustrates the use of the present invention on tobacco after it has been subjected to bulk fermentation. FIG. 3 illustrates this example.

Tobacco as it was obtained from the bulk fermentation process 50 had a pH of 6.7, a moisture content of about 64% by weight and an average nicotine content (NC) of about 2.4% by weight. This tobacco was subject to a drying step 52 to drop the moisture to about 39% by weight. This dried tobacco was then divided into two samples labelled Sample A, 54, and Sample B, 56. Sample B, 56, was mixed, 58, with 4% by weight, solid sodium carbonate monohydrate which resulted in producing a 8.5 pH.

Sample B was then cold sweated, 60, for 10 weeks at a temperature between 60° F. to 90° F. at about 1 atmosphere. Cold sweating step 60 was accomplished by placing Sample B tobacco in cardboard boxes measuring 3'×3'×4' and storing the sample in a warehouse for 10 weeks. Each carton held about 200 pounds of tobacco. The boxes were lightly sealed to allow for the circulation of air into and out of the box.

Sample A was held, 62, in the same warehouse under the same conditions without the 4% sodium carbonate monohydrate addition.

At the end of the cold sweat, Sample B was divided in half, Sample B-1, 66, and Sample B-2, 68. Sample B-1, 66, was subject to a drying step 70 done in a conventional manner to obtain a moisture content of 14% by weight.

Next, each sample was tested for pH and nicotine content. Each sample had the results shown in Table I below. FIG. 3 reflects the values in Table I. Samples A, B-1 and B-2 test results are reported in boxes 72, 74 and 76, respectively.

Next, salts and flavoring were added to each sample and the moisture content increased to 122% by weight. The final nicotine values are reported in Table I below as well as in FIG. 3. In FIG. 3 the final nicotine values are reported for Samples A, B-1 and B-2 in the blocks 78, 80 and 82 respectively.

TABLE I

| | Before Aging | | After Aging | | After Flavoring |
|---|---|---|---|---|---|
| Sample | pH | % dry weight NC | pH | % dry weight NC | % NC on finished product weight |
| A | 6.7 | 2.4 | 6.7 | 2.2 | 0.99 |
| B-1 | 6.7 | 2.4 | 8.5 | 1.1 | 0.50 |
| B-2 | 6.7 | 2.4 | 8.5 | 1.1 | 0.55 |

Moisture and pH were measured following usual practices in the tobacco industry.

In order to measure nicotine content ISO Method 3400-1976 (E) slightly modified was used. That method is used to measure the nicotine content in cigarette smoke tar. Dilute sulfuric acid was used to extract the nicotine from the tobacco, using 100 mL acid per 10 g. An aliquot of this extract was generally about 3 mL representing 0.3 g of tobacco or of tobacco product weight of sample which was then introduced into the distillation flask in place of the methanolic smoke condensate solution. When the amount of nicotine in the tobacco was low, an aliquot of extract representing a 0.5 g sample of tobacco was used to increase the amount of nicotine being measured in the analysis. The percent nicotine was based on a dry weight basis.

It is clear that the procedure of the present invention decreases the nicotine content by about 50% compared to moist snuff made from untreated tobacco product.

The tobacco used for this example was Western Dark Fire.

EXAMPLE 2

This example is a taste test of moist snuff made from tobacco product produced in accordance with the present invention.

A panel of 14 individuals were each given a quantity of moist snuff made from a tobacco product denicotized in accordance with the present invention. Each of the 14 individuals use moist snuff on a regular basis. Each of the panelists was of the opinion that the moist snuff made from tobacco product of the present invention was comparable to conventional snuff and, in fact, a number of the panelists found the moist snuff made from tobacco product of the present invention to be superior to conventional moist snuff. Such snuff possessed a mellowness not heretofore known in moist snuff. It is both surprising and unexpected that snuff with less nicotine produced in accordance with this invention had superior flavor and aroma compared to conventional snuff.

EXAMPLE 3

This example illustrates conventional tobacco held at the same temperature, pressure and moisture content versus a similar tobacco held at a pH of about 8.5.

TABLE II

| Sample | (% Nicotine dry basis) Time (weeks) 0 | 10 | 12 | 15 |
|---|---|---|---|---|
| Conventional | 2.45 | | | 2.45 |
| Present Invention | 2.38 | 1.65 | 1.55 | |

Each sample was held at about 1 atm, between about 60° to about 80° F. in an aerobic environment. The pH of the sample marked Present Invention was adjusted initially to about 8.5 with sodium carbonate monohydrate. The pH of the conventional sample was acidic, about 7 and below.

The sample marked Conventional started at a moisture content of about 35% and the sample marked Present Invention had an initial moisture content of about 40% by weight.

EXAMPLE 4

This example illustrates the difference between a moisture content of about 30% and about 20%. Both samples had a pH of about 8.5.

TABLE III

| | Time (weeks) 0 | 11 | 15 |
|---|---|---|---|
| Sample 1 | | | |
| Nicotine Content (%) | 2.38 | 1.82 | 1.55 |
| Moisture (%) | 40 | 34 | 29 |
| Sample 2 | | | |
| Nicotine Content (%) | 2.39 | 1.98 | 1.86 |
| Moisture | 33 | 24 | 21 |

Both samples initially had the pH of the sample adjusted to about 8.5 with sodium carbonate monohydrate. Both samples were maintained in aerobic environment at about 1 atm. For the period between 0 and 11 weeks, both samples were maintained at a temperature less than about 60° F. On the eleventh week, both samples were moved to a room which had a controlled temperature of about 85° F.

EXAMPLE 5

This example illustrates the effect of temperature on the process of the present invention. Table IV below illustrates the results obtained.

TABLE IV

| | Time (weeks) 0 | 5 | 8 |
|---|---|---|---|
| Sample A | | | |
| Nicotine Content (% by weight) | 2.38 | 2.05 | 2.05 |
| Moisture (% by weight) | 40 | 39 | 39 |
| Temperature (°F.) | below 60 | below 60 | below 60 |
| Sample B | | | |
| Nicotine Content (% by weight) | 2.18 | 1.87 | 1.70 |
| Moisture (% by weight) | 43 | 36 | 35 |
| Temperature (°F.) | 85 | 85 | 85 |

Both samples were held at a pressure of about 1 atm in an aerobic environment. Both Samples A and B initially had their pH adjusted to about 8.5 with sodium carbonate monohydrate. The samples held at 85° F. produced superior results.

It will be understood that the claims are intended to cover all changes and modifications of the preferred embodiments of the invention herein chosen for the purpose of illustration which do not constitute a departure from the spirit and scope of the invention.

What is claimed is:

1. A method for removing nicotine from tobacco comprising the steps of:

(a) mixing a tobacco having a moisture level of about 25% to about 53% by weight with an alkalinizing agent to obtain a mixture having a pH of about 8 to about 11; and (b) maintaining the mixture in an aerobic environment at a temperature of about 40° F. to about 120° F., at a pressure of about 1 atmosphere for a period of about 4 to about 14 weeks thereby removing nicotine from the tobacco.

2. The method of claim 1 wherein said alkalinizing agent is sodium carbonate.

3. The method of claim 2 wherein said sodium carbonate is present in an amount of about 1% to about 6% by weight.

4. The method of claim 1 wherein the mixture is maintained at a temperature of about 85° F.

5. A method for reducing nicotine content in tobacco without deleteriously affecting the flavor and aroma in the tobacco comprising the steps:

(a) drying tobacco obtained from a bulk fermentation process having a pH of about 7 and below, down to a moisture level between about 25% to about 53% by weight;

(b) mixing the dried tobacco with an alkalinizing agent to obtain a mixture having a pH between about 8 to about 11; and (c) maintaining the mixture in an aerobic environment at a temperature between about 40° F. to about 120° F. at a pressure of about 1 atmosphere for a period of about 4 to about 14 weeks whereby the nicotine content of the tobacco is reduced.

6. The method of claim 5 wherein said alkalinizing agent is sodium carbonate.

7. The method of claim 6 wherein said sodium carbonate is present in an amount between about 1% to 6% by weight.

8. The method of claim 6 wherein the temperature is about 60° to about 100° F.

9. The method of claim 5 wherein the alkalinizing agent is an aqueous solution of alkalinizing agent.

10. The method of claim 5 wherein the pH of the mixture is about 8 to about 9.

11. The method of claim 5 wherein the pH of the mixture is about 8.5

12. The method of claim 5 wherein the period is about 4 to about 12 weeks.

13. The method of claim 5 wherein the tobacco is dried to a moisture level of between about 36% to about 42%, the pH of the mixture is about 8.5, the temperature is maintained at about 85° F., and the mixture is held for a period of about 5 to about 8 weeks.

14. A method for removing nicotine from tobacco comprising the steps:

(a) obtaining a tobacco from a bulk fermentation process having a pH of about 7 and below, and a moisture content between about 56% to about 82% by weight;

(b) drying said tobacco to a moisture level of about 25% to about 53% by weight;

(c) mixing the dried tobacco with about 1% to about 6% sodium carbonate by weight to obtain a mixture having a pH of about 8 to about 11; and (d) maintaining the mixture in an aerobic environment, at a temperature of about 40° F. to about 120° F. at a pressure of about 1 atmosphere for a period of about 4 to about 14 weeks thereby removing nicotine from the tobacco without deleteriously affecting the flavor and aroma of the tobacco.

* * * * *